US006450265B1

(12) United States Patent
Ponte

(10) Patent No.: US 6,450,265 B1
(45) Date of Patent: Sep. 17, 2002

(54) LARGE ORIFICE ESFR SPRINKLER ARRANGEMENT

(75) Inventor: Gary W. Ponte, Livingston, NJ (US)

(73) Assignee: The Reliable Automatic Sprinker Co., Inc., Mount Vernon, NY (US)

( * ) Notice: Subject to any disclaimer, the term of this patent is extended or adjusted under 35 U.S.C. 154(b) by 0 days.

(21) Appl. No.: 09/620,456

(22) Filed: Jul. 20, 2000

(51) Int. Cl.[7] ..... A62C 37/08

(52) U.S. Cl. ..... 169/37; 167/41; 167/56; 167/57; 239/504; 239/500

(58) Field of Search ..... 169/37–42, 56–58; 239/498, 500, 518, 524, 504

(56) References Cited

U.S. PATENT DOCUMENTS

| | | | | | |
|---|---|---|---|---|---|
| 2,125,510 | A | * | 8/1938 | Lewis | 169/37 |
| 2,129,012 | A | * | 9/1938 | Lewis | 169/37 |
| 2,357,227 | A | * | 8/1944 | Rowley | 169/37 |
| 2,502,754 | A | | 4/1950 | Rowley | |
| 3,714,989 | A | * | 2/1973 | Gloeckler | 169/37 |
| 3,998,273 | A | | 12/1976 | Juliano | |
| 4,553,603 | A | | 11/1985 | Dwyer | |
| 4,580,729 | A | | 4/1986 | Pounder | |
| 4,930,578 | A | | 6/1990 | Barnett et al. | |
| 4,976,320 | A | | 12/1990 | Polan | |
| 5,020,601 | A | | 6/1991 | Retzloff et al. | |
| 5,097,906 | A | * | 3/1992 | Polan | 169/37 |
| 5,366,022 | A | | 11/1994 | Meyer et al. | |
| 5,494,113 | A | | 2/1996 | Polan | |
| 5,579,846 | A | | 12/1996 | Meyer et al. | |
| 5,609,211 | A | | 3/1997 | Meyer et al. | |
| 5,664,630 | A | | 9/1997 | Meyer et al. | |
| 5,829,532 | A | | 11/1998 | Meyer et al. | |
| 6,059,044 | A | * | 5/2000 | Fischer | 169/37 |
| 6,367,559 | B1 | | 4/2002 | Winebrenner | |

* cited by examiner

*Primary Examiner*—Lesley D. Morris
*Assistant Examiner*—Christopher Kim
(74) *Attorney, Agent, or Firm*—Baker Botts, LLP

(57) ABSTRACT

A large orifice ESFR sprinkler arrangement has a sprinkler body with a frame supporting a deflector in spaced relation to an orifice in the sprinkler body. The orifice is selected to provide a K factor of at least 16, preferably 19 to 25, and desirably 22. The deflector has a planar surface facing the sprinkler body and is formed with twelve equally spaced radially extending slots each of which has sides which diverge outwardly at an angle of about 7.5° with respect to the center line of the slot. A projecting member mounted on the deflector and facing the outlet orifice in the sprinkler body has a convexly curved outer surface extending from a tip disposed on the sprinkler axis downwardly and outwardly to a cylindrical portion having an outer diameter which is about 98% of the diameter of the base circle at the inner ends of the slots.

28 Claims, 4 Drawing Sheets

LARGE ORIFICE ESFR SPRINKLER ARRANGEMENT

BACKGROUND OF THE INVENTION

This invention relates to early suppression fast response sprinklers which have large orifices so as to distribute large quantities of water at low working pressures.

Early suppression, fast response (ESFR) sprinklers are designed to provide rapid response to a detected fire hazard by delivering increased water densities in order to satisfy the actual delivered density (ADD) and distribution requirements with various ceiling heights for improved fire suppression in which the ESFR sprinklers are to be used. Conventionally, ESFR sprinklers have had a K factor of 14 and various sprinkler standards have specified K14 as the standard size for ESFR sprinklers. Recently, ESFR sprinklers have been designed with larger orifices, and correspondingly higher K factors, to meet the need for high flow rates at lower fluid pressures, and to avoid the necessity for a booster pump. Factory Mutual Research has established ADD requirements for such ESFR sprinklers having a higher K factor.

The Meyer et al. U.S. Pat. No. 5,829,532 discloses low pressure ESFR sprinklers having nominal K-factors greater than 16 and, specifically, a sprinkler having a K factor of 25 which is capable of delivering at least one hundred gallons per minute at an operating pressure of 20 psi and requiring a minimum pressure of only 15 psi. A particular sprinkler described in that patent has a sprinkler body with an outlet orifice with a minimum diameter of 0.930 inches and includes a pair of support arms extending forwardly and outwardly from the sprinkler body and then laterally inwardly toward the sprinkler axis to form a tubular knuckle supporting a deflector on the side facing the orifice in the sprinkler body. The deflector includes a planar circular plate having a plurality of angularly spaced radial slots of uniform width extending inwardly from the periphery of the deflector to a central region which supports a hemispherical nose piece facing the orifice.

U.S. Pat. No. 5,494,113 discloses a sprinkler having a planar deflector supported by arms similar projecting forwardly and outwardly from a sprinkler body and joined in a deflector support on the opposite side of the deflector from the orifice in the sprinkler body. In that patent, a central deflecting cone is mounted on the deflector facing the sprinkler orifice. U.S. Pat. No. 4,580,729 discloses a sprinkler having arms projecting forwardly and outwardly from the sprinkler body and then inwardly to a conical boss supporting a sprinkler deflector on the side opposite from the sprinkler body, and according to that patent, the half angle of the cone should be in a range from about 5° to 50°. The Reliable Automatic Sprinkler Co. Inc., Model H ESFR Sprinkler has a K factor of 14 and has a circular deflector with radial slots of uniform width and a central nose cone with a nose cone included angle of about 60°. U.S. Pat. Nos. 2,502,754, 4,553,603, 5,020,601 and 3,998,273 schematically illustrate sprinklers having deflectors with radial slots in which the side of the slots diverge in the outward direction of the slot at substantial unspecified angles.

It has now been found, however, that large orifice, high K factor sprinklers do not provide as efficient water distribution with the same deflector arrangements which are effective with smaller orifice, lower K factor sprinklers.

SUMMARY OF THE INVENTION

Accordingly, it is an object of the present invention to provide a large orifice, low pressure ESFR sprinkler which overcomes disadvantages of the prior art.

Another object of the invention is to provide a large orifice, low pressure ESFR sprinkler arrangement providing more efficient water distribution.

A further object of the invention is to provide a large orifice ESFR sprinkler arrangement having a more efficient deflector arrangement and therefore requiring less water at the same pressure as a sprinkler having a higher K factor but nevertheless effective to provide the same protection as a sprinkler having the higher K factor.

An additional object of the invention is to provide an ESFR sprinkler arrangement having a nominal K factor of 22 but providing the same effective water distribution as a conventional sprinkler having a nominal K factor of 25.

These and other objects of the invention are attained by providing an ESFR sprinkler having a sprinkler body with an outlet orifice and a substantially planar deflector disc supported from the sprinkler body and having radial slots with sides diverging outwardly from the inner end and a central projecting member facing the orifice which has a convexly curved surface of revolution. The convex curved surface of the projecting member tends to direct water toward the center of the region beneath the sprinkler while the slots with diverging sides tend to assure good distribution at the outer portions of the region to be protected. Preferably, the slot sides diverge from the center line of the slots at an angle in a range from about 5° to 10°. In addition, the small end of the projecting member is preferably rounded with a spherical radius of about 0.05 inches and is located about 0.5 inch away from the surface of the deflector disc while the large end of the projecting member has a diameter of about 0.55 to 0.65 inches and substantially covers the central region of the deflector inside the inner ends of the deflector slots. In one embodiment the sprinkler has a K factor of 22 and the radius of curvature of the convex surface of the projecting member is about twice the length of the projecting member.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
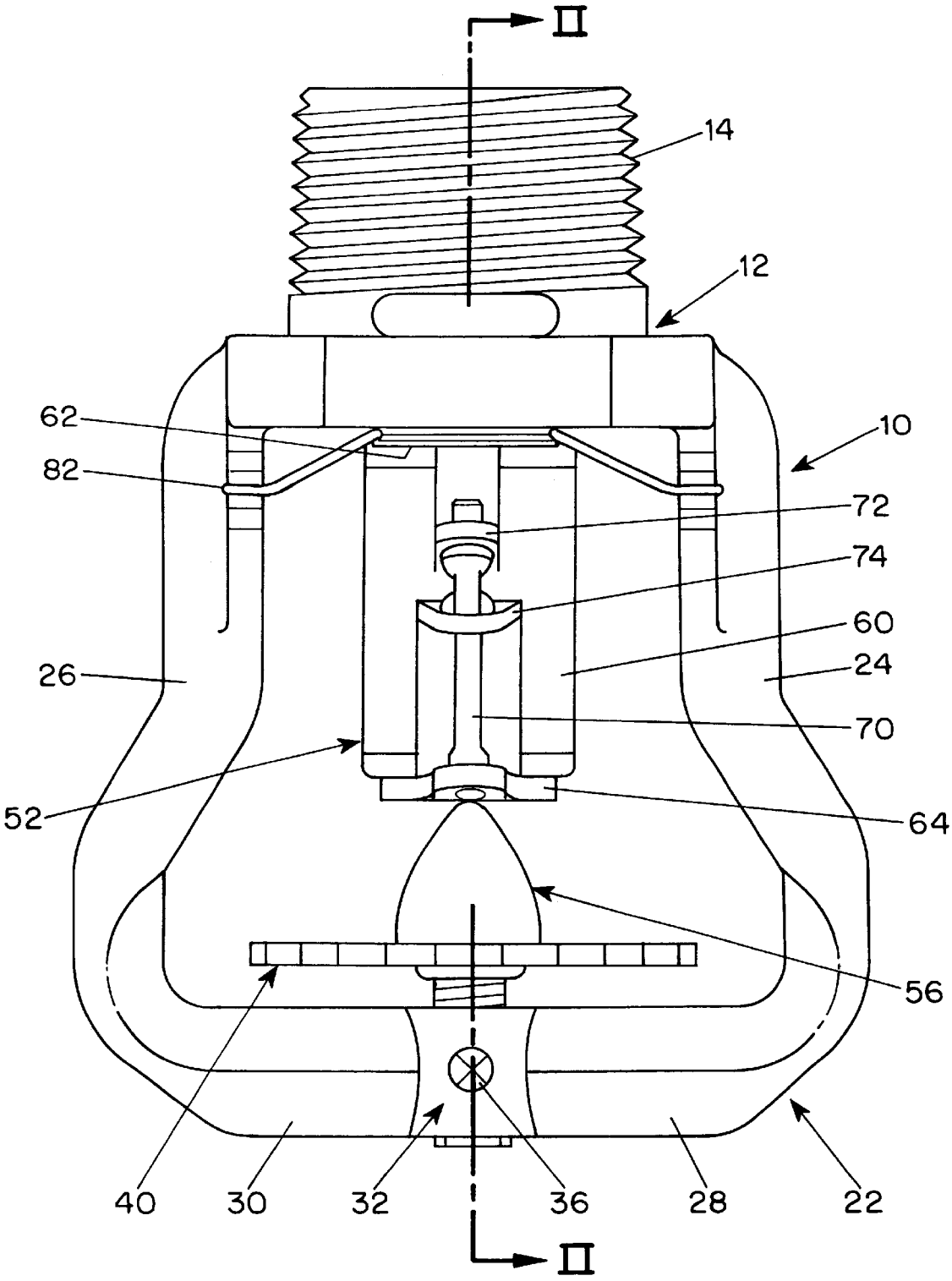
FIG. 1 is a side view illustrating a representative embodiment of a large orifice ESFR sprinkler arrangement in accordance with the invention.

In the typical embodiment of the sprinkler arrangement according to the invention shown in the drawings, a large orifice ESFR sprinkler 10 has a sprinkler body 12 with a threaded end 14 adapted to be connected to a supply pipe for fire extinguishing fluid such as water and having a central passage 16 terminating in an orifice 18 through which the water is delivered when the sprinkler is activated. The orifice 18 is selected to provide a K factor of at least 16, in particular embodiments about 19 to 25, and in a preferred embodiment about 22.

It will be understood that the term "large orifice ESFR sprinkler", as used herein, is intended to refer to ESFR sprinklers having an orifice larger than that providing a K factor of 14 as previously specified for ESFR sprinklers and does not refer to sprinklers having an orifice of about 17/32 inch, or a nominal K factor of 8, which have sometimes been known as "large orifice" sprinklers.

Figure 2:
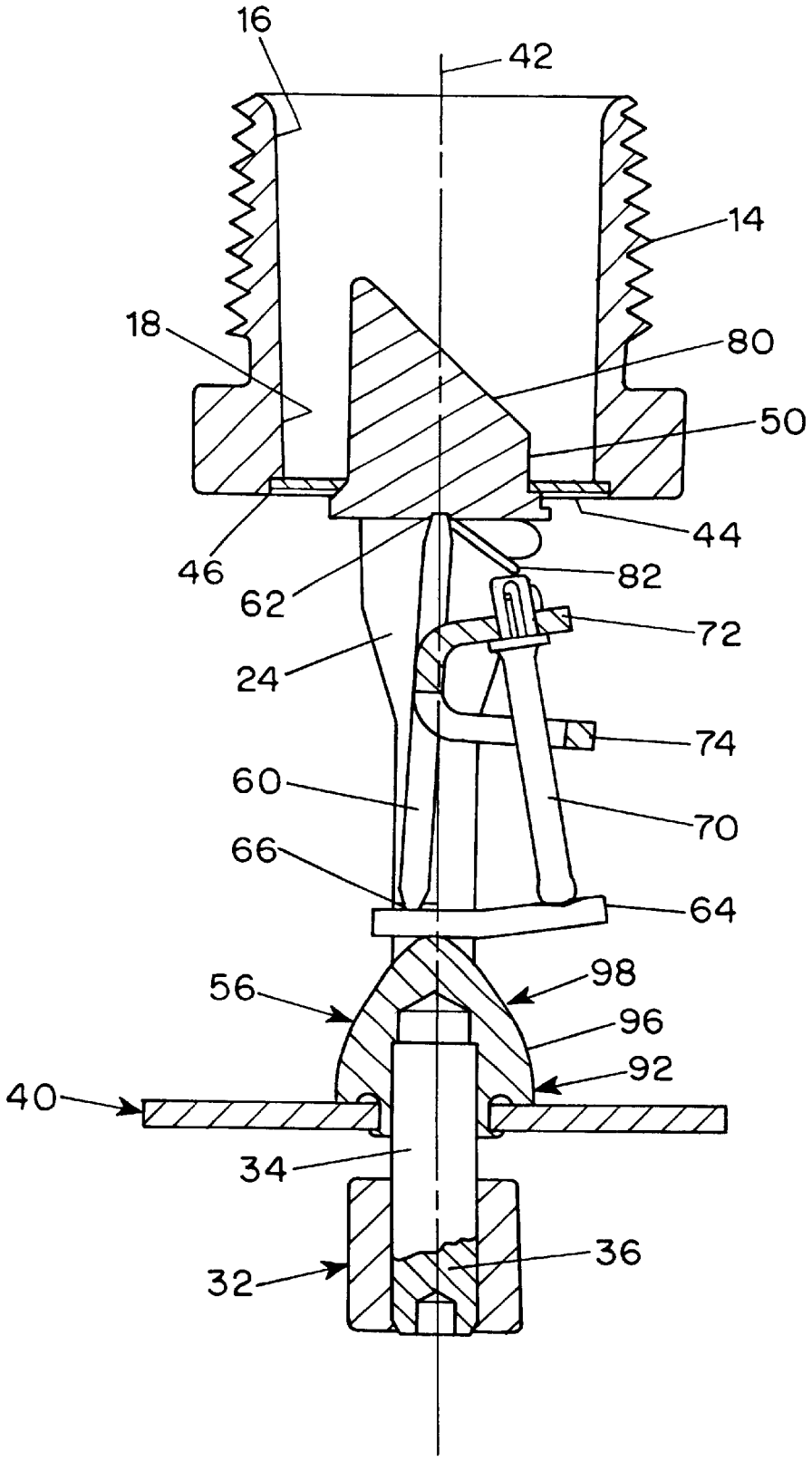
FIG. 2 is a view in longitudinal section taken on the line II—II of FIG. 1 and looking in the direction of the arrows.
Figure 3:
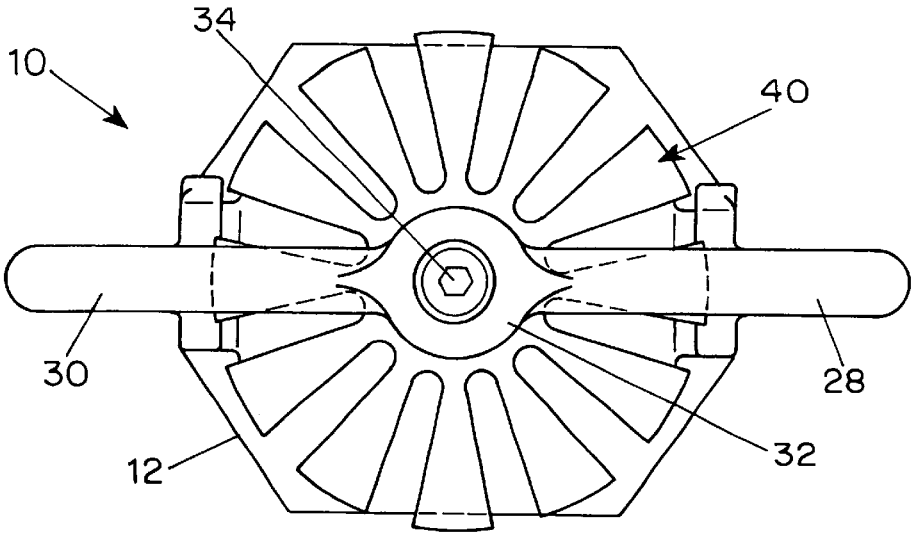
FIG. 3 is bottom view of the sprinkler arrangement of FIG. 1.

As shown in FIG. 1, a frame 22, consisting of two frame arms 24 and 26, projects forwardly from opposite sides of the sprinkler body 12 and terminates in laterally extending portions 28 and 30 which are joined at a boss 32. A screw 34 threaded in the boss 32 and retained in position therein by a stake 36 supports a substantially planar deflector 40 disposed perpendicular to the axis 42 of the sprinkler body in spaced relation to the orifice 18 at the end of the passage 16 in the sprinkler body as shown in FIG. 2.

In order to normally seal the passage 16 and retain water under pressure therein, a spring washer 44 is held in position in a seat 46 at the end of the passage 16 by plug 50 which is retained in position by a thermally responsive assembly 52. The thermally responsive assembly engages the plug 50 at one end and is seated at the opposite end on a projecting member 56 which is centrally positioned on the deflector 40 and has a convexly curved outer surface configuration similar to that of a bullet. In order to release the plug 50 at a selected elevated temperature, the thermally responsive assembly 52 includes a strut member 60 which engages the plug 50 at one end 62 on the axis 42 of the sprinkler body and engages a lever 64 at its opposite end 66 at a location spaced laterally from the axis 42 of the sprinkler body and a glass bulb 70 extends from the opposite end of the lever member 64 to an arm 72 projecting laterally from the strut member 60. In addition, a guard ring 74 also projects from the strut member 60 and surrounds the glass bulb 70 to provide protection against accidental breakage. The glass bulb is designed to rupture when the ambient temperature to which it is subjected reaches a predetermined elevated temperature such as 155° F. or 200° F., for example.

Consequently, upon rupture of the glass bulb 70 at an elevated temperature, the end of the lever 64 which is normally supported by the glass bulb 70 moves toward the projecting arm 72, releasing the end 66 of the strut member 60 so as to cause the thermally responsive assembly 52 to collapse and permit the plug 50 to be ejected from the orifice 18. As shown in FIG. 2, the plug 50 has an inclined rear surface 80 which causes it to be ejected in a lateral direction by the force of the emerging water so as to avoid any hang up on the surface of the deflector 40. The other components of the thermally responsive assembly 52 are similarly urged by a spring 82 away from the surface of the deflector thereby permitting free flow of water from the orifice 18 toward the projecting member 56 and the deflector 40.

Figure 4:
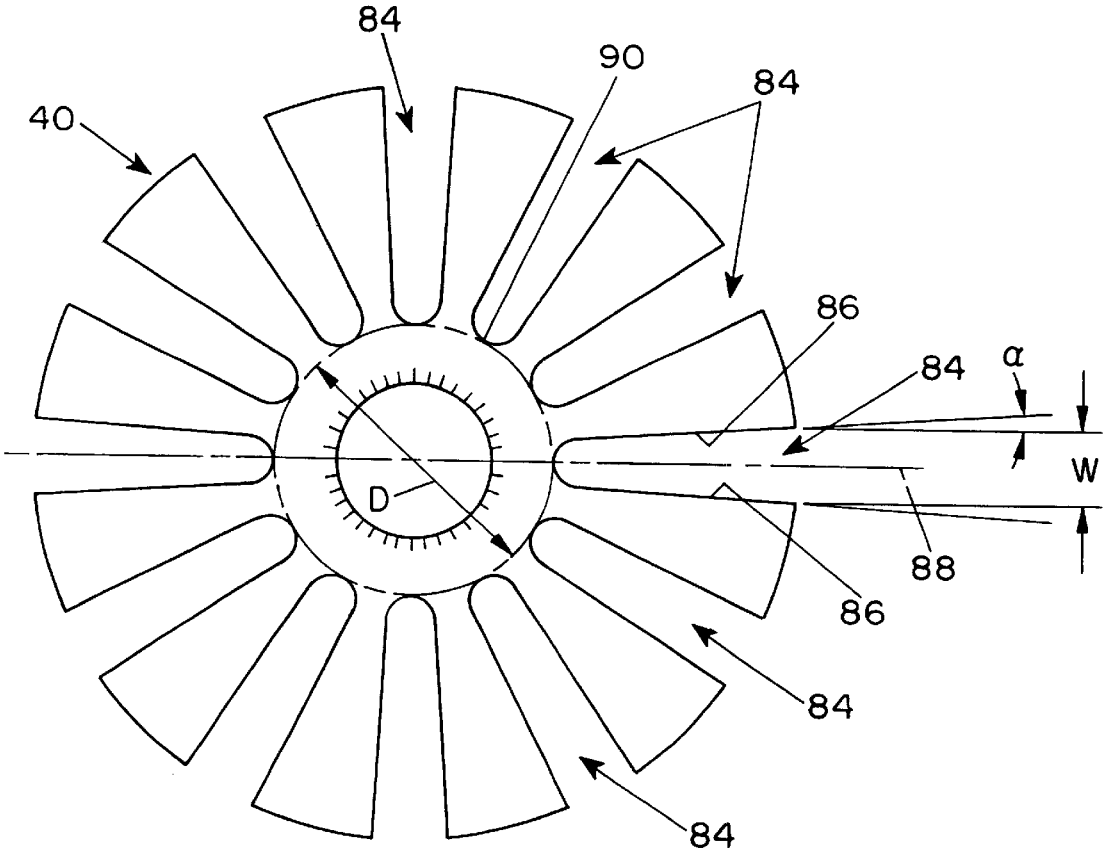
FIG. 4 is an enlarged view of the deflector in the sprinkler of FIG. 1.

As best seen in FIG. 4, the deflector 40 is formed with twelve equally spaced radially extending slots 84, each of which has opposed sides 86 which diverge outwardly at an angle $\alpha$ with respect to the direction of the center line 88 of the slot. The angle $\alpha$ is preferably in the range from about 2° to 12° and desirably from about 5° to 10° and most preferably about 7.5°, and the slots 84 have a maximum width W in the range from about 0.14 inch to about 0.18 inch, and preferably about 0.16 inch. A base circle 90 which is defined by the inner ends of the slots 84 preferably has a diameter D in the range from about 0.5 inch to about 0.65 inch and desirably a diameter of about 0.58 inch while the outer diameter of the deflector is preferably in the range from about 1.5 inch to 1.7 inch and desirably about 1.6 inch.

Figure 5:
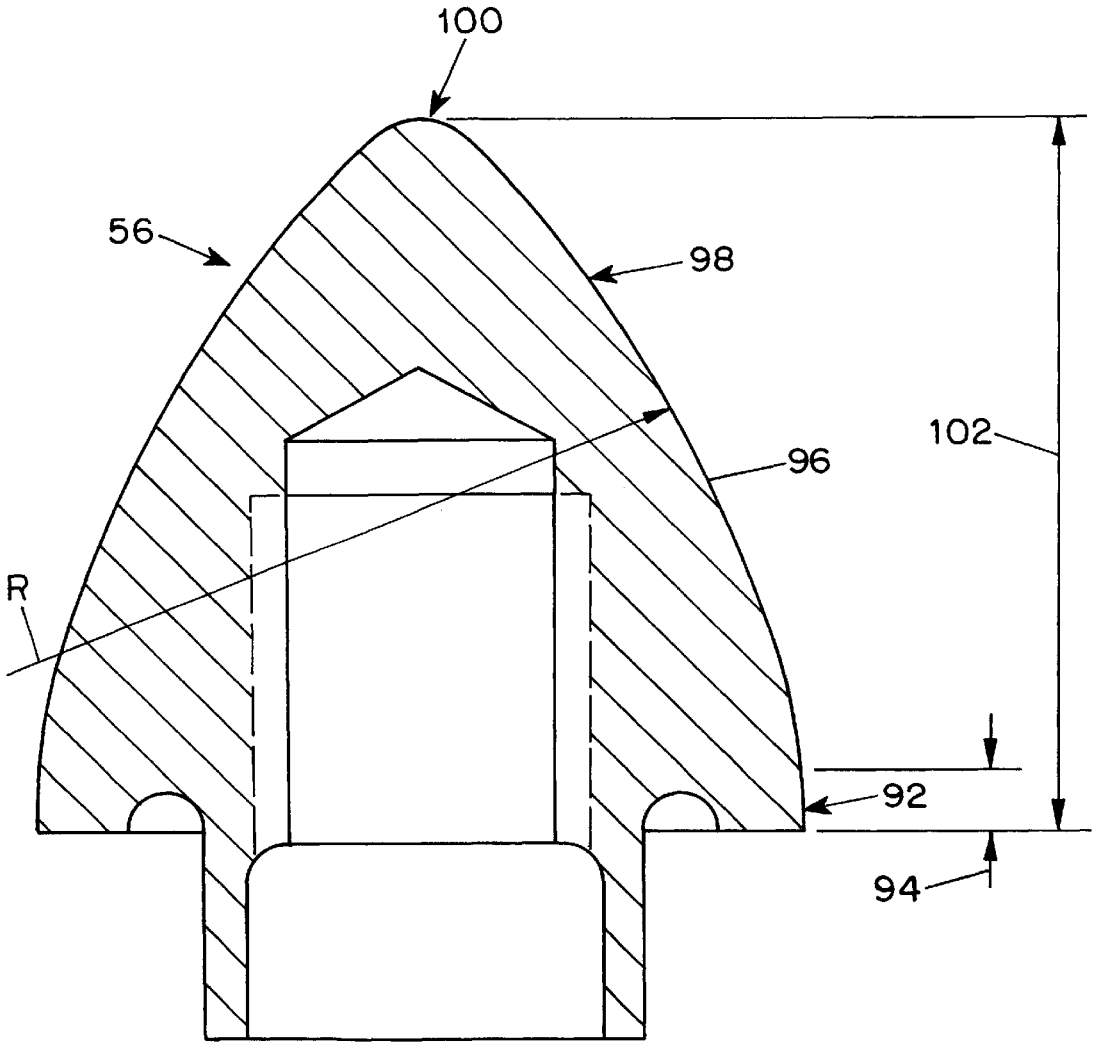
FIG. 5 is an enlarged cross-sectional view of the projecting member of the sprinkler arrangement shown in FIG. 1.

As best seen in FIG. 5, the projecting member 56 has a cylindrical base portion 92 with a diameter which is preferably about 95 to 100% of the diameter D of the base circle 90 and desirably about 98% of the base circle diameter. In one embodiment, the diameter of the cylindrical base portion is 0.10 inch to 0.15 inch less than the base circle diameter D and preferably has a value in the range from about 0.55 to 0.6 inch and desirably about 0.57 inch. The cylindrical base portion 92 of the projecting member 56 extends away from the deflector 40 by a distance 94 which is about 0.03 to 0.05 inch. In a preferred embodiment, the outer surface 96 of the curved surface portion 98 above the cylindrical base portion 92 of the projecting member 56 has a convexly curved configuration with a radius R of about 0.9 inch to about 1 inch, and desirably about 0.94 inch and terminates in a rounded tip 100 which has a radius of about 0.05 inch. The total length 102 of the projecting member 56 from the tip 100 to the deflector 40 is preferably about 40% to about 70% and desirably about 55% of the radius of the surface 96. In a preferred embodiment, the length 102 of the projecting member 56 is about 0.5 to about 0.6 inch and desirably about 0.55 inch.

With this arrangement, water emerging under pressure from the orifice 18 in the sprinkler body is guided by the curved surface 96 of the projecting member 56 in such a way that a portion of the water follows the curved surface and then the cylindrical surface of the base portion 92 so as to pass through the inner ends of the slots 84 around the base circle 90 and be distributed in the central portion of the region beneath the sprinkler deflector while the diverging deflector slots assure adequate distribution in the outer portions of the protected region.

As a result of the improved distribution characteristics of the sprinkler arrangement in accordance with the invention, it has been found that the total water flow rate can be reduced while still satisfying the Factory Mutual ADD requirements for large orifice ESFR sprinklers of a given type. For example, with the sprinkler arrangement according to the invention the relevant fire test requirements for a structure with a ceiling height of 45 feet at a water pressure of 50 psi can be satisfied with a sprinkler having a nominal K factor of 22, i.e., one with an orifice having a diameter about 88% of that of a nominal K 25 sprinkler, thereby producing a flow rate of 158 gallons per minute rather than the 178 gallons per minute produced by a K 25 sprinkler of conventional structure which is necessary to pass fire tests and satisfy the Factory Mutual ADD requirements. Similarly, a sprinkler arrangement according to the invention having a K factor of 22 satisfies not only the fire test requirements but also the Factory Mutual ADD requirements for a structure with a ceiling height of 35 feet at a pressure of 30 psi while requiring a flow rate of only 122 gallons per minute in comparison with the 138 gallons per minute required by the standard K 25 sprinkler in order to satisfy the Factory Mutual ADD requirements. Thus, it has now been determined based on comparison tests of large orifice ESFR sprinkler arrangements that an ESFR sprinkler arrangement according to the invention with a K factor of 22 provides the optimum operating characteristics for structures with ceiling heights in the range from about 30 feet to about 45 feet.

Although the invention has been described herein with reference to specific embodiments many modifications and variations therein will readily occur to those skilled in the art. Accordingly, all such variations and modifications are included within the intended scope of the invention.

I claim:

1. An early suppression fast response sprinkler arrangement comprising:

a sprinkler body having an orifice providing a K factor of at least 16 and two frame arms which extend forwardly from the sprinkler body on opposite sides of the orifice and meet at a junction on the sprinkler axis;

a deflector supported by the frame arms in spaced relation to the orifice in the sprinkler body at a location between the junction of the frame arms of the orifice to deflect water emerging from the orifice;

a plurality of angularly distributed radial slots in the deflector in which each slot has sides which diverge at an angle in the radially outward direction of the slot; and a bullet-shaped projecting member centrally positioned on the deflector and facing the orifice in the sprinkler body and having an outer surface consisting of a surface of revolution about the sprinkler axis extending entirely around the projecting member which is convexly curved continuously from a tip on the axis of the sprinkler body outwardly and downwardly toward the deflector and a cylindrical surface adjacent to the deflector to guide water striking the bullet-shaped projecting member toward the inner ends of the slots in the deflector.

2. A sprinkler arrangement according to claim 1 wherein the outer diameter of the convexly outer curved surface of the projecting member is in the range from about 95% to about 100% of the base circle diameter of the inner ends of the slots in the deflector.

3. A sprinkler arrangement according to claim 1 wherein the convexly curved outer surface of the projecting member has a radius in the range from about 0.9 inch to about 1 inch.

4. A sprinkler arrangement according to claim 3 wherein the convexly curved outer surface of the projecting member has a radius of about 0.95 inch.

5. A sprinkler arrangement according to claim 1 wherein the projecting member includes a cylindrical base portion between the convexly curved outer surface and the deflector with an axial dimension in a range from about 0.03 to about 0.05 inch.

6. A sprinkler arrangement according to claim 1 wherein the convexly curved outer surface has a radius of curvature and the distance between the tip and the deflector is less than the radius of curvature of the convexly curved outer surface.

7. A sprinkler arrangement according to claim 6 wherein the radius of the curvature of the convexly curved outer surface is about twice the distance between the tip and the deflector.

8. A sprinkler arrangement according to claim 1 wherein each of the radial slots has sides which diverge outwardly at angles in a range from about 2° to about 12° with respect to the direction of the center line of the slot.

9. A sprinkler arrangement according to claim 8 wherein the sides of each slot extend at an angle in a range from about 5° to about 10° with respect to the center line of the slot.

10. A sprinkler arrangement according to claim 9 wherein the sides of each slot diverge outwardly at an angle of about 7.5° with respect to the center line of the slot.

11. A sprinkler arrangement according to claim 1 wherein the slots have a maximum width in a range from about 0.14 inch to about 0.18 inch.

12. A sprinkler arrangement according to claim 11 wherein the slots have a maximum width of about 0.16 inch.

13. A sprinkler arrangement according to claim 1 wherein the sprinkler body has an orifice which provides a K factor of at least 19.

14. A sprinkler arrangement according to claim 13 wherein the sprinkler body has an orifice providing a K factor in a range from about 19 to 25.

15. A sprinkler arrangement according to claim 14 wherein the sprinkler body has an orifice providing a K factor of about 22.

16. A sprinkler arrangement according to claim 1 including a sealing arrangement for normally sealing the orifice in the sprinkler body and a thermally responsive assembly for retaining the sealing arrangement in place and releasing the sealing arrangement at a selected elevated temperature.

17. A sprinkler arrangement according to claim 16 wherein the thermally responsive assembly releases the sealing arrangement at an elevated temperature of about 155° F.

18. A sprinkler arrangement according to claim 16 wherein the thermally responsive assembly releases the sealing arrangement at an elevated temperature of about 200° F.

19. A sprinkler arrangement according to claim 16 wherein the thermally responsive assembly includes a glass bulb arranged to rupture at the selected elevated temperature.

20. A sealing arrangement according to claim 19 wherein the thermally responsive assembly includes a strut and lever arrangement retained in position by the glass bulb.

21. A sprinkler arrangement according to claim 20 wherein the strut and lever arrangement includes a guard surrounding the glass bulb.

22. A sprinkler arrangement according to claim 16 wherein the thermally responsive assembly extends between the tip of the projecting member and the sealing arrangement.

23. A sprinkler arrangement according to claim 1 wherein the deflector is a substantially planar disc.

24. A sprinkler arrangement according to claim 1 wherein the deflector has twelve equally spaced radially extending slots.

25. A sprinkler arrangement according to claim 1 wherein the deflector has a diameter in a range from about 1.5 inch to about 1.7 inch.

26. A sprinkler arrangement according to claim 25 wherein the deflector has a diameter of about 1.6 inch.

27. An early suppression fast response sprinkler arrangement comprising:

a sprinkler body having an orifice providing a nominal K factor of 22 and two frame arms which extend forwardly from the sprinkler body on opposite sides of the orifice and meet at a junction on the sprinkler axis;

a deflector supported by the frame arms in spaced relation to the orifice in the sprinkler body at a location between the junction of the frame arms of the orifice to deflect water emerging from the orifice and having a plurality of angularly distributed radial slots; and a bullet-shaped projecting member centrally positioned on the deflector and facing the orifice in the sprinkler body;

wherein the projecting member has an outer surface consisting of a surface of revolution about the sprinkler axis extending entirely around the projecting member which is convexly curved from a tip on the axis of the sprinkler body outwardly and downwardly toward the deflector and a cylindrical surface adjacent to the deflector to guide water striking the bullet-shaped projecting member toward the inner ends of the slots in the deflector.

28. An early suppression fast response sprinkler arrangement comprising:

a structure having a ceiling height in a range from about 30 feet to about 45 feet; and a plurality of early suppression fast response sprinkler arrangements mounted adjacent to the ceiling wherein each sprinkler arrangement comprises;

a sprinkler body having an orifice providing a nominal K factor of 22 and two frame arms which extend forwardly from the sprinkler body on opposite sides of the orifice and meet at a junction on the sprinkler axis;

a deflector supported by the frame arms in spaced relation to the orifice in the sprinkler body at a location between the junction of the frame arms of the orifice to deflect water emerging from the orifice and having a plurality of angularly distributed radial slots; and a bullet-shaped projecting member centrally positioned on the deflector and facing the orifice in the sprinkler body;

wherein the projecting member has an outer surface consisting of a surface of revolution about the sprinkler axis extending entirely around the projecting member which is convexly curved from a tip on the axis of the sprinkler body outwardly and downwardly toward the deflector and a cylindrical surface adjacent to the deflector to guide water striking the bullet-shaped projecting member toward the inner ends of the slots in the deflector.

* * * * *